US006789946B2

(12) United States Patent
Plourde et al.

(10) Patent No.: US 6,789,946 B2
(45) Date of Patent: Sep. 14, 2004

(54) EASILY ALIGNABLE ZIPPER FOR RECLOSABLE PACKAGING

(75) Inventors: Eric Paul Plourde, Homewood, IL (US); Randall Wayne Yoder, Steger, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/047,795

(22) Filed: Oct. 23, 2001

(65) Prior Publication Data

US 2003/0077008 A1 Apr. 24, 2003

(51) Int. Cl.[7] ..... B65D 33/16
(52) U.S. Cl. ..... 383/63; 24/399; 24/400
(58) Field of Search ..... 383/63, 64; 24/399, 24/400

(56) References Cited

U.S. PATENT DOCUMENTS

| | | | | |
|---|---|---|---|---|
| 3,325,084 A | | 6/1967 | Ausnit | |
| 3,338,285 A | * | 8/1967 | Jaster | 383/65 |
| 3,808,649 A | * | 5/1974 | Ausnit | 383/63 |
| 4,747,702 A | * | 5/1988 | Scheibner | 383/63 |
| 4,778,282 A | * | 10/1988 | Borchardt et al. | 383/63 |
| 4,787,880 A | | 11/1988 | Ausnit | |
| 4,829,641 A | * | 5/1989 | Williams | 24/585.12 |
| 4,906,494 A | * | 3/1990 | Babinec et al. | 428/35.2 |
| 4,907,321 A | * | 3/1990 | Williams | 24/585.12 |
| 4,917,506 A | * | 4/1990 | Scheibner | 383/63 |
| 5,211,481 A | * | 5/1993 | Tilman | 383/63 |
| 5,774,955 A | * | 7/1998 | Borchardt et al. | 24/584.1 |

* cited by examiner

*Primary Examiner*—Robin A. Hylton
(74) *Attorney, Agent, or Firm*—Ostrager Chong; Flaherty & Broitman P.C.

(57) ABSTRACT

A plastic zipper for use in a reclosable package or bag. The zipper includes a pair of fastener strips respectively having male and female interlockable members formed thereon. The male member has a profile with an expanded head. The female member has a profile with a groove for receiving the expanded head of the male member. The female member preferably includes a base, first and second walls extending from the base, first and second hooks respectively extending from the first and second walls toward a center plane of the female member, and first and second wings respectively extending from the first and second walls away from the center plane. The wings have surfaces for guiding an impinging male member toward an opening defined by the hooks of the female member. Preferably, the plastic zipper has a target width to zipper height ratio substantially equal to or greater than unity.

23 Claims, 4 Drawing Sheets

PRIOR ART

EASILY ALIGNABLE ZIPPER FOR RECLOSABLE PACKAGING

FIELD OF THE INVENTION

The present invention relates to bags or packages such as may be formed from plastic film and having an openable mouth with a reclosable extruded plastic fastener or zipper situated inside the mouth. The zipper has complementary profiles that are interlocked when the zipper is closed and can be separated to open the zipper. Bags or packages of this kind are well known and in widespread use.

BACKGROUND OF THE INVENTION

In the use of plastic bags and packages, particularly for foodstuffs, it is important that the bag be hermetically sealed until the purchaser acquires the bag and its contents, takes them home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper is one which has a grooved member at one side of the bag mouth and a ribbed member at the other side, which rib may interlock into the groove when the sides of the mouth of the bag are pressed together. Alternatively, a member having a plurality of ribs may be on one side of the bag mouth, while a member having a plurality of channels may be on the other side, the ribs locking into the channels when the sides of the mouth of the bag are pressed together. In such a case, there may be no difference in appearance between the two members, as the ribs may simply be the intervals between channels on a strip that may lock into another of the same kind. In general, and in short, some form of male/female interengagement is used to join the two sides of the bag mouth together. The so-called members, or strips, are bonded in some manner to the material from which the bags themselves are manufactured. Usually, pull flanges extend above the rib and groove strips, which pull flanges may be pulled apart for access to the interior of the bag.

Although flexible zippers of this variety are quite popular, a person attempting to close a reclosable package or bag having opposing ribbed and grooved zipper strips must align the rib with the groove before pressing the rib into the groove. Typically, this is accomplished by pressing the zipper strips together between a thumb and opposing forefinger on one hand while holding one end of the zipper in the other hand. The aligning and pressing procedure must be performed continuously or at multiple discrete intervals along the length of the zipper in order to fully close the mouth of the package or bag. When the reclosable package or bag is made of thin flexible plastic material, it is easy for the plastic fastener strips of the zipper to flex so that the rib and groove are out of alignment in a given area. The larger the size of the package or bag, the greater the amount that the central portions of the fastener strips can misalign. Also, when zipper segment halves are not joined at the segment ends, the user must initiate the closing without any pre-aligned portion of the zipper. Also, although the nature of the construction is such that when the package or bag is empty and flat, the fastener strips are prone to be aligned, misalignment is more likely when the package or bag has been filled and the plastic film of the package or bag has been distended or otherwise shaped by the contents. Consequently, a person may have difficulty closing a reclosable package or bag due to misalignment of the rib and groove fastener strips at one or more points along the length of the zipper.

One parameter which is useful in quantifying the degree to which a plastic zipper is susceptible to misalignment is an aspect ratio formed by dividing the width of the target (i.e., the distance separating apices at the inlet of the female member) by the height of the zipper (i.e., the distance from the back of one fastener strip to the back of the other fastener strip when the male and female members are interlocked). In the prior art zippers known to the inventor, the foregoing aspect ratio is substantially less than unity.

There is a need for a zipper design that makes it easier for a person to cause the interlockable faster strips of a plastic zipper to interlock during closure of reclosable package or bag.

SUMMARY OF THE INVENTION

The present invention is directed to a reclosable package or bag having a mouth with an extruded flexible plastic zipper with interlockable male and female members installed in the mouth, the zipper being designed to facilitate alignment of the interlockable male and female members when a consumer tries to close the zipper.

In accordance with one preferred embodiment of the invention, the zipper has an aspect ratio substantially equal to or greater than unity. More specifically, the female member has target apices separated by a distance substantially equal to or greater than the height of the zipper as measured from the bases of the male and female members.

In accordance with another preferred embodiment, the female zipper member comprises opposing resilient walls with outwardly directed extensions or wings at the distal ends of the walls which serve to increase the distance between the target apices, preferably to attain an aspect ratio substantially equal to or greater than unity. These outwardly directed wings guide an off-target or misaligned incoming male zipper member toward the opening in the female member during attempts to close the zipper.

In one example of the second preferred embodiment, the extruded female member comprises a pair of resilient walls having a channel or groove therebetween for receiving the head of the male member, respective inwardly directed extensions (defining an opening therebetween), and respective outwardly directed extensions, both sets of extensions extending from the distal ends of the resilient walls of the female member. Preferably, each wall and its associated inwardly and outwardly directed extensions are integrally formed. Each outwardly directed extension of the female zipper member preferably has an inclined camming surface which is oriented to guide the impinging tip of the incoming male zipper member toward the center plane of the female member. In effect, the outwardly directed extensions funnel the tip of a misaligned incoming male member toward the opening between the inwardly directed extensions of the female member, thereby aligning the male and female members.

In the disclosure which follows, the inwardly directed extensions of the female member will be referred to as "hooks" whereas the outwardly directed extensions of the female member will be referred to as "wings".

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DETAILED DESCRIPTION OF THE PREFERRED EMBODIMENTS

Figure 1:
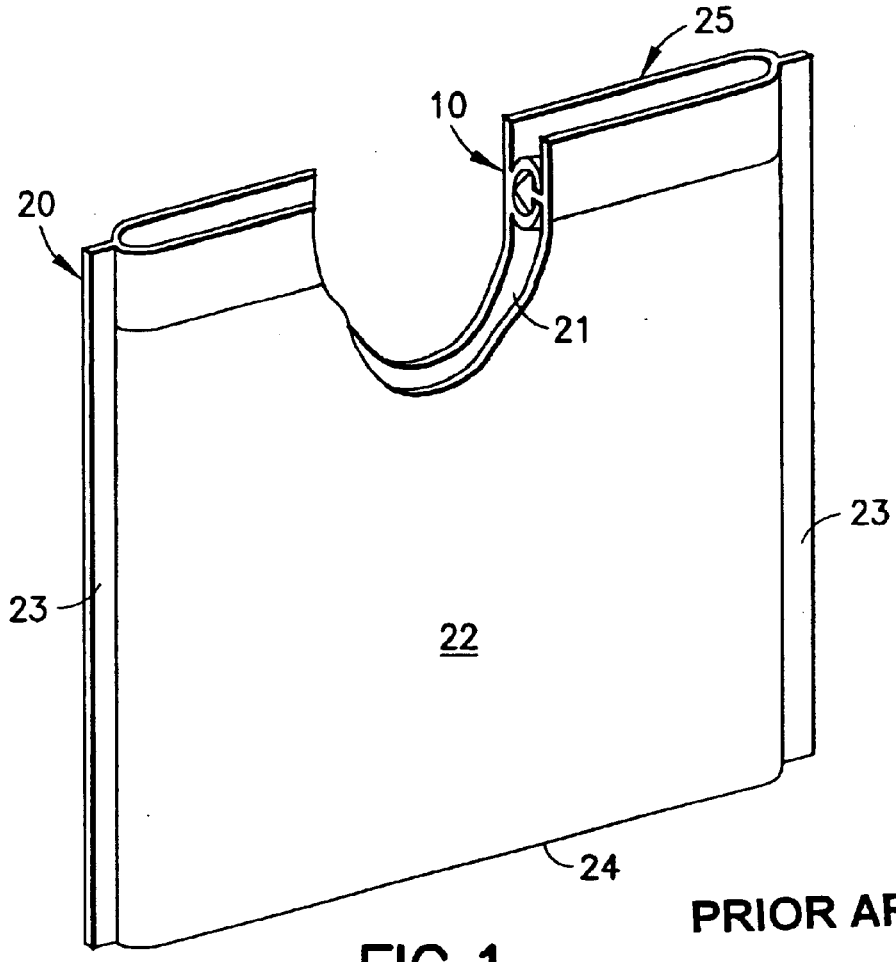
PRIOR ART FIG. 1
FIG. 1 is a drawing showing a perspective view of a reclosable bag, partially broken away for revealing details of structure, and embodying a conventional plastic zipper.

Reference will now be made to the drawings, in which similar elements in different drawings bear the same reference numerals. The structure of a conventional reclosable bag having a flexible plastic zipper will be generally described with reference to FIGS. 1–3. Then the structure of a zipper assembly in accordance with a first preferred embodiment will be described with reference to FIGS. 4 and 5; and the structure of a zipper assembly in accordance with a second preferred embodiment will be described with reference to FIGS. 6 and 7. It should be understood that the zipper assemblies shown in FIGS. 5 and 7 can be installed in a reclosable bag of the type shown in FIG. 1 or in any other reclosable package having a mouth which can be opened and closed using a flexible plastic zipper.

Figure 2:
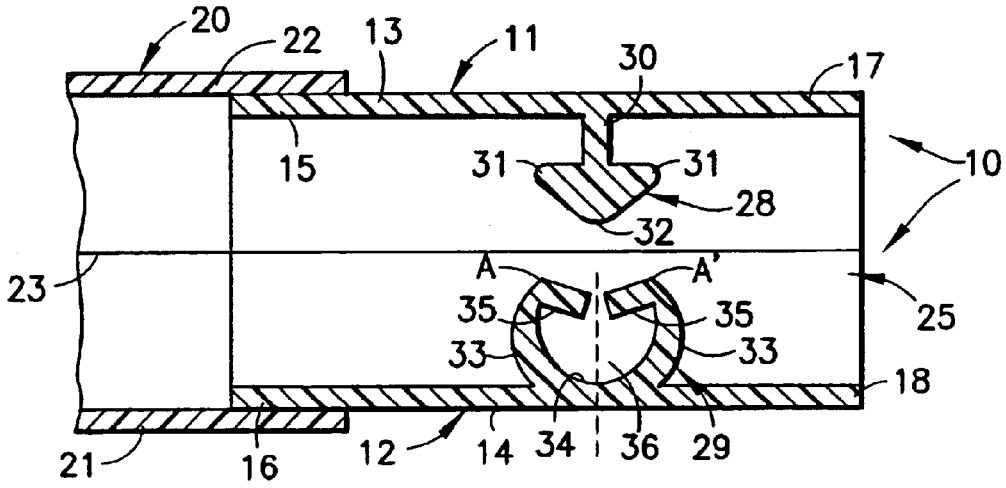
PRIOR ART FIG. 2
FIG. 2 is a drawing illustrating the mouth end of the bag of FIG. 1 when the zipper is open.
Figure 3:
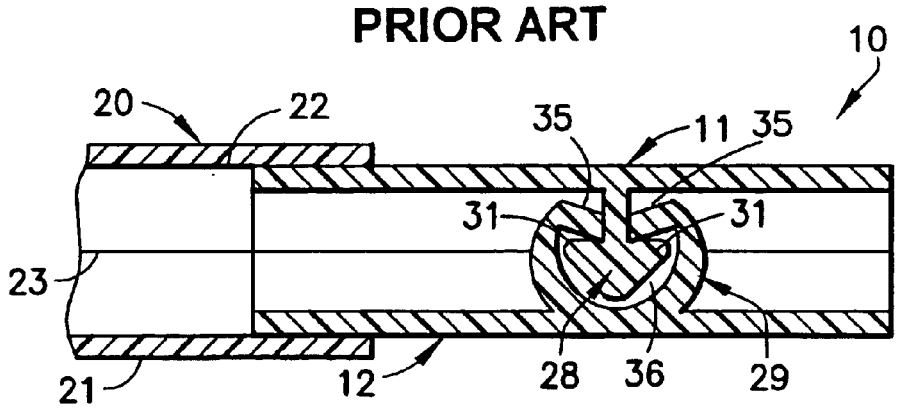
FIG. 3 is a drawing illustrating the mouth end of the bag of FIG. 1 when the zipper is closed.

Referring to FIGS. 1–3, a bag 20 may be made from any suitable sheet material or plastic film and comprises opposite wall panels 21 and 22, which may be secured together at opposite side edges of the bag by seams 23. At a bottom edge 24 the wall panels 21 and 22 are joined, for example, by means of folding the sheet material to oppose to sections of wall material or sealing the sheet material panels at their opposing bottom edges. At its top end, the bag 20 has an openable mouth 25 on the inside of which is an extruded plastic fastener or zipper assembly 10. The zipper assembly 10 comprises a pair of interlockable fastener strips 11 and 12.

In one desirable conventional form, the zipper assembly 10 is an extruded plastic structure which comprises a first fastener strip 11 having a male member 28 and a second fastener strip 12 having a female member 29. The male member 28 has a generally arrow-shaped rib-like male profile; the female member 29 has a complementary, generally groove-shaped female profile. Each fastener strip further comprises a respective base web 13, 14. By preference, each base web 13, 14 is of resiliently flexible self-supporting form and may be thicker than the wall panels 21, 22. Also, each web 13, 14 may have an inwardly directed (inward in the sense that it is directed toward the inside of the bag) web flange section (or portion) 15 or 16, which may be secured, for example, by means of heat sealing or adhesive to the associated bag wall panel 21 or 22. As a result, the zipper webs 13, 14, as best seen in FIGS. 2 and 3, form part of the mouth 25 of the bag. To facilitate opening manipulation of the zipper 10, the webs 13, 14 may be provided with outwardly extending (away from the bag interior) sections (or portions) 17, 18. The consumer can grip the respective web portions 17, 18 between respective thumbs and opposing forefingers and then pull the web portions 17, 18 apart until the male and female members 28, 29 of the respective fastener strips disengage.

In a typical zipper, the profile of the male member 28 has a stem 30 flanked by shoulders 31 of the main rib portion of the profile, and a tip 32 of the profile points toward the opposing female member 29, the tip 32 being the point of the male member furthest away from the web 13. The profile of the female member 29 comprises a pair of gripper jaws extending from a base or root 34 of the female member. Each jaw comprises a wall 33 and a hook 35 integrally formed at the distal end of the respective wall 33. The hooks 35 are inclined and generally directed toward each other, the distal ends of the hooks 35 defining a mouth which communicates with a groove 36 defined by walls 33 and root 34. The groove 36 receives the head of the male member 28 when the zipper is closed. The walls 33 and the root 34 are preferably integrally formed with the web 14.

When the male member 28 is properly aligned with and then moved into engagement with the female member 29, the head of the male member will penetrate the opening in the female member 29. As the head of male member 28 penetrates, the opposing resilient hooks 35 of the gripper jaws are pushed toward the groove root 34 and are cammed apart by the inclined surfaces running from the tip 32 to the shoulders 31 of the male member 28. The camming force exerted on the hooks 35 by the head of the penetrating male member is transferred to the resilient walls 33 of the gripper jaws, causing those walls to flex outwardly. The walls 33 are flexed outward, in opposite directions, until the hooks 35 of the female member pass by and snap into interlocking relation behind the shoulders 31 of the male member, as shown in FIG. 3. The head of the male member 28 is received in the groove 36 and held there by the interlocked hooks 35.

To open the closed zipper, the web portions 17 and 18 are pulled apart with sufficient force to pull the head of the male member 28 out of the female member 29. When the shoulders 31 clear the hooks 35 of the outwardly flexed gripper jaws, the male and female members are no longer interlocked and the zipper is no longer closed.

Referring again to FIG. 2, the target-defining apices of the gripper jaws are designated by A and A' respectively and the center plane of the female member 29 is indicated by the dashed line. If the tip 32 is directly aligned with the center plane of the female member, then the male member 28 can penetrate the female member directly. If the tip 32 of the male member, at the instant when it engages the female member, is offset from the center plane, yet still within the region bounded by the apices A and A', then when the head impinges on the inclined outer surface of a hook 35, the latter will guide the head of the male member 28 toward the center plane, i.e., toward the opening defined by the distal edges of the hooks 35. Then the male member can penetrate the female member and be received in the groove 36. Alternatively, if the tip 32 of the male member, at the instant when it engages the female member, is outside the region bounded by the apices A and A', then when the head impinges on an apex A or A', the head of the male member 28 will not be guided toward the opening in the female member, interlocking of the male and female members will not occur, and the consumer's attempt to close the package will have failed. In this case, the consumer must try again.

Figure 4:
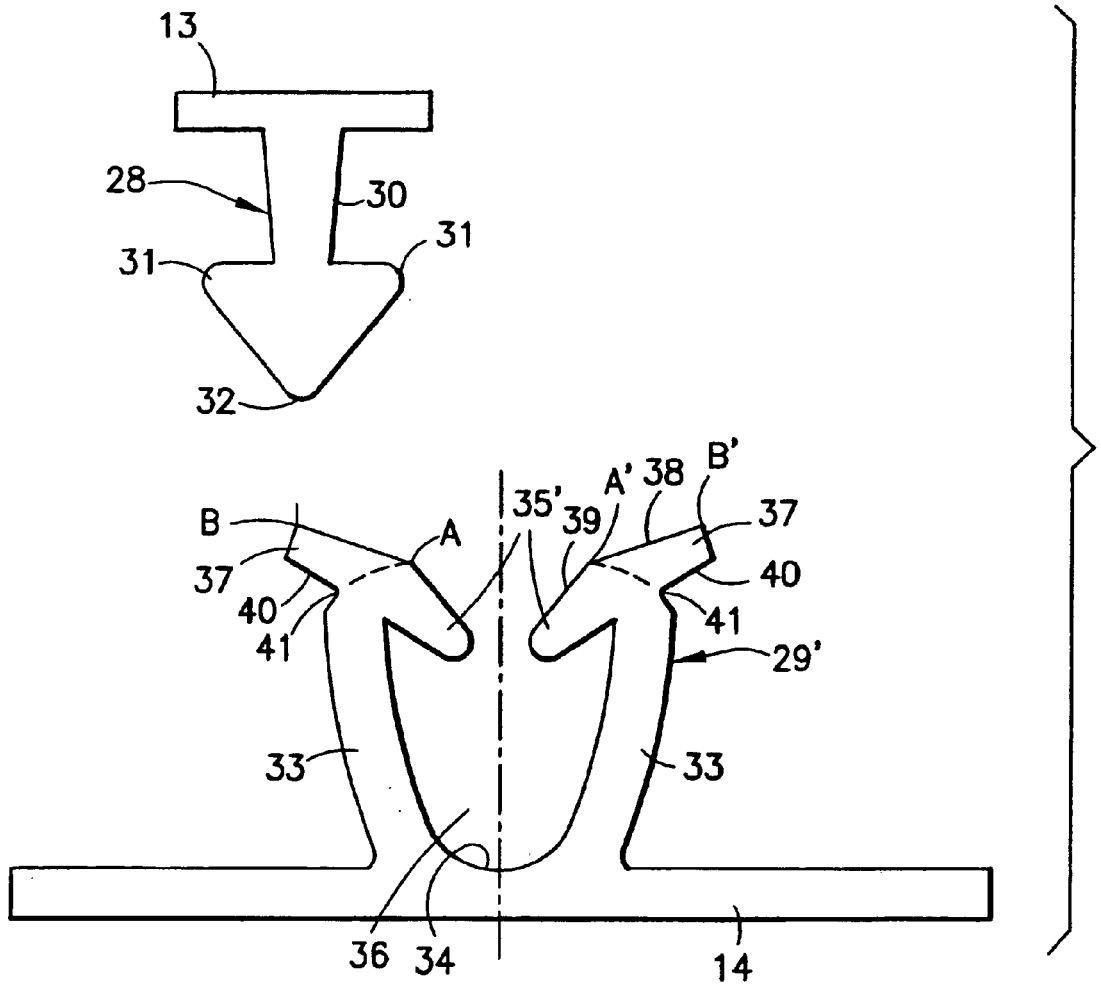
FIGS. 4 and 5 are drawings illustrating the respective profiles of the fastener strips for a zipper in the open and closed states respectively, in accordance with a first preferred embodiment of the invention.

The present invention seeks to make it easier for a consumer to align the male and female members of a zipper for closing a reclosable package or bag. In accordance with the first preferred embodiment, this is accomplished by increasing the maximum offset of the target apices of the female member by incorporating extensions, i.e., wings, that extend outwardly from the ends of the resilient walls of the gripper jaws. FIG. 4 shows an end view of a fastener strip 11 comprising a conventional male member 28 and a fastener strip 12 comprising a female member 29' in accordance with one preferred embodiment, the zipper being shown in an open state.

The fastener strip 11 comprises a web 13 and a male member 28 integrally formed, e.g., by extrusion, with the web 13. The male member 28 comprises a stem 30 extending from, generally perpendicular to and integrally formed with the web 13, and a head integrally formed with and at the end of the stem 30, the head comprising a pair of shoulders 31 and a tip 32. Although not shown in FIG. 4, the fastener strip 11 can be attached to one wall of a package or bag by conventional means, e.g., heat sealing or fusing the web 13 to the package wall on one side of the package mouth.

The fastener strip 12 comprises a web 14 and a female member 29' integrally formed, e.g., by extrusion, with the web 14. The female member 29' comprises a base or root 34 integrally formed with the web 14 and a pair of resilient walls 33 each having a proximal end integrally formed with the web 14. In accordance with the preferred embodiment of the invention, the female member 29' further comprises a pair of inwardly directed hooks 35' and a pair of outwardly directed wings 37 which extend in opposite directions from the distal end of each wall 33. Each wall 33 has a hook 35' and a wing 37, all three portions being integrally formed as a generally T-shaped side, the wall forming a stem portion and the hook and wing forming a transverse portion. Preferably, each wing 37 has a front surface 38 that is generally flat and inclined relative to the plane of web 14, and each hook 35' has a front surface 39 that is generally flat and inclined relative to the plane of web 14. The term "inclined", as used herein, means neither parallel to nor perpendicular to. Preferably the front surface 38 is closer to parallel with the plane of web 14 than is the front surface 39, or the front surfaces 38 and 39 can be co-planar.

For the sake of illustration, curved dashed lines have been added to FIG. 4 to show what the boundary of typical gripper jaws would be without the outwardly directed wings 37. One aspect of the invention can be described in terms of the relationship of the apices of the wings 37 to the apices of the gripper jaws indicated by the dashed line. More specifically, one wing 37 has a front face which extends from the apex A of the gripper jaw to an apex B, while the other wing 37 has a front face which extends from the apex A' of the gripper jaw to an apex B', the apices B and B' of the wings 37 being laterally offset from the center plane by an amount greater than the lateral offset of the apices A and A', respectively, of the gripper jaws.

Looking at the preferred embodiment from a different perspective, the geometry can alternatively be characterized in terms of the profile of each side of the female member 29'. As seen in FIG. 4, each side of the female member 29' has a generally T-shaped profile wherein the transverse portion of the T is generally not parallel to the plane of the web or base 14 and the stem portion is generally upright relative to the base 14. In particular, the surfaces of the transverse portion on which the expanded head of the male member can impinge are inclined to guide the head toward the opening defined by hooks 35'.

In accordance with a further alternative characterization of the structure of the female zipper member shown in FIG. 4, each wing has a rear surface 40 which meets the side surface of the respective wall 33 at a junction 41. In accordance with the preferred embodiment, the apices B and B' of the wings 37 are laterally offset from the center plane by an amount greater than the lateral offset of the respective junction 41. As used in the claims, the term "outer junction" refers to a junction of the type indicated by reference numeral 41.

Figure 5:
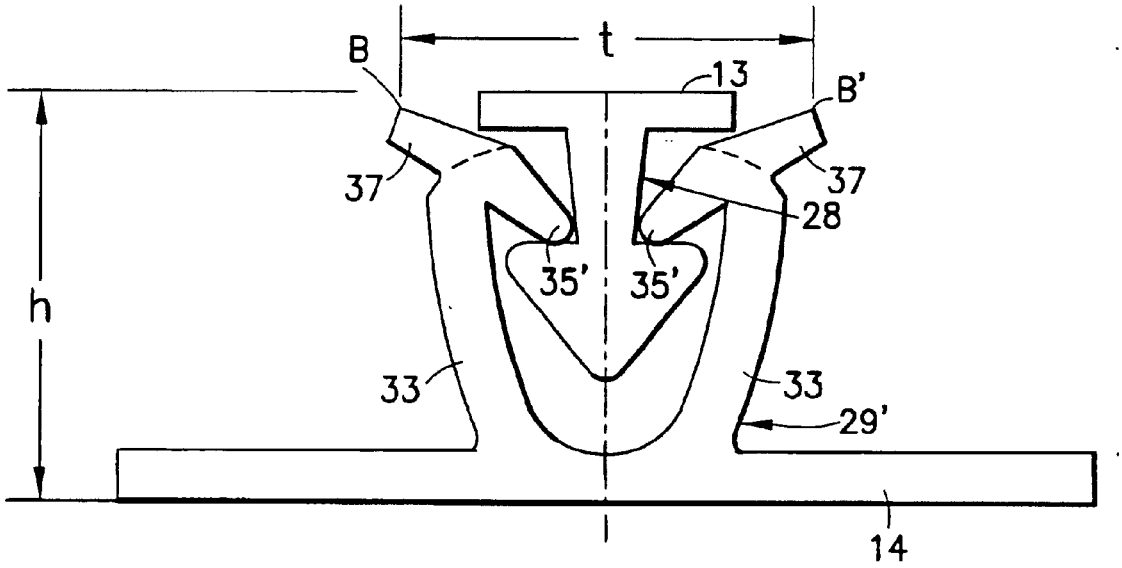

The zipper in accordance with the above-described embodiment is shown in a closed state in FIG. 5, with the head of the male member 28 located inside the groove 36 of the female member 29'. For the embodiment depicted in FIG. 5, the aspect ratio t/h is substantially equal to unity, where t is the distance between the target apices and h is the distance from base to base. However, zippers in accordance with the first preferred embodiment may alternatively have an aspect ratio greater than unity.

Figure 6:
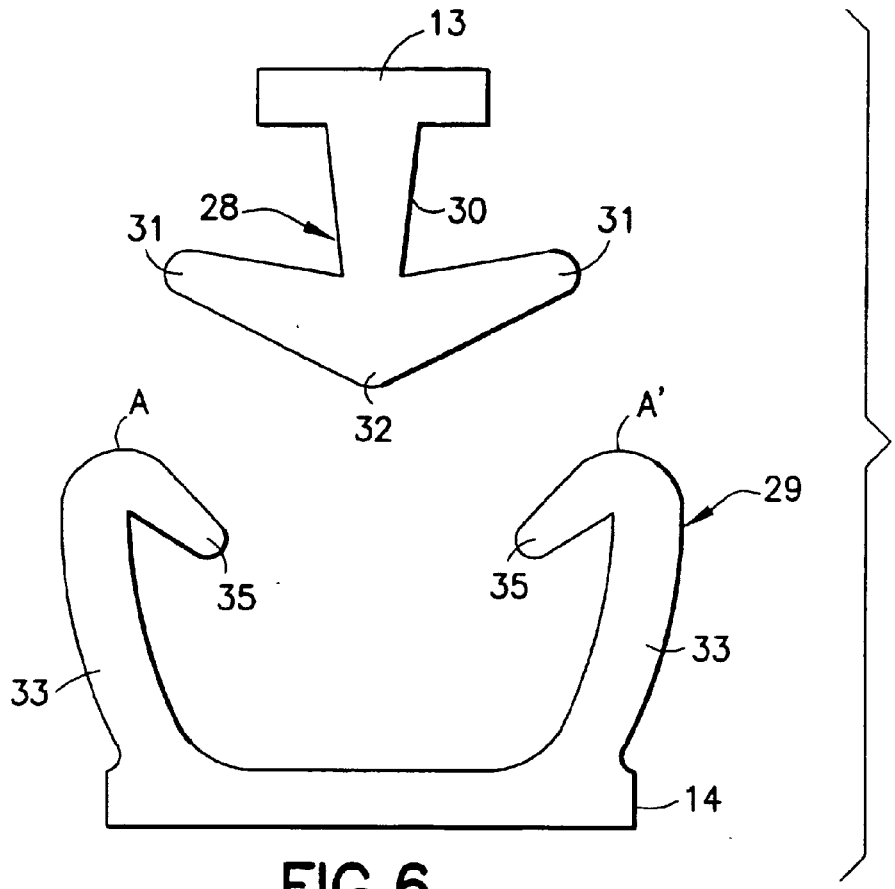
FIGS. 6 and 7 are drawings illustrating the respective profiles of the fastener strips for a zipper in the open and closed states respectively, in accordance with a second preferred embodiment of the invention.
Figure 7:
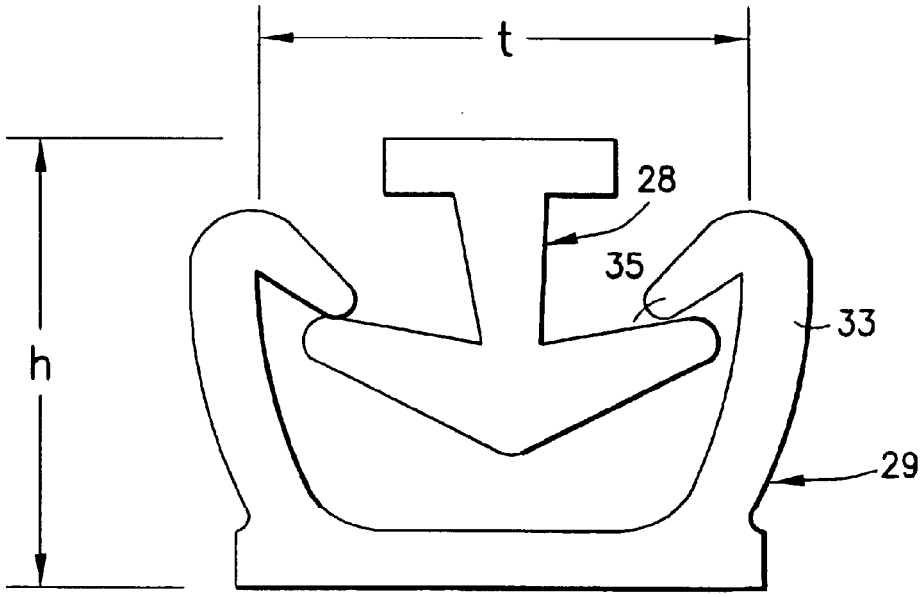

A second preferred embodiment is shown in FIGS. 6 and 7: FIG. 6 shows this zipper in an open state; FIG. 7 shows this zipper in a closed state. The zipper has a conventional design, i.e., the male member 28 has an arrow-shaped head and the female member 29 has inwardly directed hooks but no outwardly directed wings. However, the expanded head of the male member and the distance between the target apices of the female member are respectively wider than their counterparts in prior art plastic zippers known to the inventor. For the embodiment depicted in FIG. 7, the aspect ratio t/h is substantially equal to unity. However, zippers in accordance with the second preferred embodiment may alternatively have an aspect ratio greater than unity. By increasing the target width for a given zipper style, the susceptibility to misalignment of the male and female members during attempts to close the zipper can be significantly diminished.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile.

In addition, although the fastener strips can be fused directly to the walls of the packaging material, this is not necessary to practice of the present invention. For example, the fastener strips could be attached to the wall panels of the package or bag by means of intermediate thermoplastic bonding strips.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" includes bags and other forms of packaging.

What is claimed is:

1. A plastic zipper comprising first and second interlockable parts, said first interlockable part having a male profile and said second interlockable part having a female profile, wherein said male profile is generally arrow-shaped, said female profile comprises inwardly facing first and second hooks and outwardly extending first and second wings, said first and second wings being sloped so as to guide said male profile towards a center plane of said female profile when said male profile impinges on either of said first and second wings during movement toward said female profile, and wherein said inwardly facing first and second hooks, when in a relaxed state, form an opening having a width less than a width of said arrow-shaped male profile, enabling said first and second hooks to latch said arrow-shaped profile to provide an interlocked state of said first and second interlockable parts.

2. The zipper as recited in claim 1, wherein said female profile further comprises first and second walls, wherein said first wall, said first hook and said first wing are integrally formed, and wherein said second wall, said second hook and said second wing are integrally formed.

3. The zipper as recited in claim 2, wherein said first wing has an apex having a lateral offset from a center plane of said female profile which is greater than a maximum lateral offset from said center plane of said first wall.

4. The zipper as recited in claim 2, wherein said first wing has an apex having a lateral offset from a center plane of said female profile which is greater than a lateral offset from said center plane of a junction of a rear surface of said first wing and a side surface of said first wall.

5. The zipper as recited in claim 2, wherein said first hook and said first wing extend in generally opposite directions from a distal portion of said first wall.

6. The zipper as recited in claim 1, wherein said second interlockable part comprises a base, said first hook has a first surface facing said first interlockable part and said first wing has a second surface facing said first interlockable part, said first and second surfaces being neither parallel nor perpendicular to a plane of said base.

7. The zipper as recited in claim 6, wherein said second surface is closer to parallel with said base plane than is said first surface.

8. A plastic zipper comprising first and second fastener strips, wherein said first fastener strip comprises a first base and a male member projecting from said first base and having a profile with an expanded head, and said second fastener strip comprises a second base and a female structure projecting from said second base and having a profile with a groove for receiving said expanded head of said male member, and wherein said female structure comprises first and second generally T-shaped sides which, when in a relaxed state, define an opening having a width less than a width of said expanded head, enabling said first and second generally T-shaped sides to latch said male member to provide an interlocked state of said first and second interlockable parts, wherein each of said first and second generally T-shaped sides has a guide surface for guiding said male member toward said opening when said male member impinges on said guide surface, said guide surface having an apex which is laterally offset from a center plane of said female structure by an amount which is greater than the lateral offset of an outer junction, said outer junction being located where an undersurface of a transverse portion meets a side surface of a stem portion of a T-shaped side, and each of said guide surfaces having a distance from said second base that increases with increasing distance from said center plane of said female structure.

9. The zipper as recited in claim 8, wherein said transverse portion and said stem portion of each of said first and second generally T-shaped sides of said female structure are integrally formed.

10. The zipper as recited in claim 8, wherein said apex of said guide surface has a lateral offset from said center plane which is greater than a maximum lateral offset from said center plane of said corresponding stem portion.

11. A package comprising a receptacle having a mouth at an upper end, a plastic zipper attached to said mouth and comprising first and second fastener strips, wherein said first fastener strip comprises a male member having a profile with an expanded head and said second fastener strip comprises a female structure having a profile with a groove for receiving said expanded head of said male member, and wherein said female structure comprises a base, first and second walls extending from said base, first and second hooks extending from said first and second walls respectively toward a center plane of said female structure, and first and second wings extending from said first and second walls respectively away from said center plane, said first and second hooks, when in a relaxed state, forming an opening having a width less than a width of said expanded head of said male member, enabling said first and second hooks to latch said male member to provide an interlocked state of said first and second interlockable parts, and said first and second wings being sloped so as to guide said male member towards said center plane of said female structure when said male member impinges on either of said first and second wings during movement toward said female structure.

12. The package as recited in claim 11, wherein said first wall, said first hook and said first wing are integrally formed.

13. The package as recited in claim 11, wherein said first wing has an apex having a lateral offset from said center plane which is greater than a maximum lateral offset from said center plane of said first wall.

14. The package as recited in claim 11, wherein said first wing has an apex having a lateral offset from said center plane which is greater than a lateral offset from said center plane of a junction of a rear surface of said first wing and a side surface of said first wall.

15. The package as recited in claim 11, wherein said first hook and said first wing extend in generally opposite directions from a distal portion of said first wall.

16. The package as recited in claim 11, wherein said first hook has a surface facing said first fastener strip and said guide surface of said first wing faces said first fastener strip, said surface of said first hook and said guide surface of said first wing being neither parallel nor perpendicular to a plane of said base.

17. The package as recited in claim 16, wherein said guide surface of said first wing is closer to parallel with said base plane than is said surface of said first hook.

18. A package comprising a receptacle having a mouth at an upper end, a plastic zipper attached to said mouth and comprising first and second fastener strips, wherein said first fastener strip comprises a first base and a male member projecting from said first base and having a profile with an expanded head and said second fastener strip comprises a second base and a female structure projecting from said second base and having a profile with a groove for receiving said expanded head of said male member, and wherein said female structure comprises first and second generally T-shaped sides defining an opening having a width less than a width of said expanded head of said male member, enabling said generally T-shaped sides to latch said male member to provide an interlocked state of said first and second fastener strips, and wherein each of said first and second generally T-shaped sides has a guide surface for guiding said male member toward said opening when said male member impinges on said guide surface, said guide surface having an apex which is laterally offset from a center plane of said female structure by an amount which is greater than the lateral offset of an outer junction, said outer junction being located where an undersurface of a transverse portion meets a side surface of a stem portion of a T-shaped side, and each of said guide surfaces having a distance from said second base that increases with increasing distance from said center plane of said female structure.

19. The package as recited in claim 18, wherein said transverse portion and said stem portion of each of said first and second generally T-shaped sides of said female structure are integrally formed.

20. The package as recited in claim 18, wherein said apex of said guide surface has a lateral offset from said center plane which is greater than a maximum lateral offset from said center plane of said corresponding stem portion.

21. A plastic zipper comprising first and second fastener strips, wherein said first fastener strip comprises a male member having a profile with an expanded head and said second fastener strip comprises a female structure having a profile with a groove for receiving said expanded head of said male member, and wherein said female structure comprises first and second hooks extending toward a center plane and defining, when in a relaxed state, an opening which communicates with said groove and having a width less than a width of said expanded head of said male member, enabling said first and second hooks to latch said male member to provide an interlocked state of said first and second fastener strips, and first and second wings extending away from said center plane, said first hook and said first wing being integrally formed and supported in a region intermediate the respective ends of said first hook and said first wing, and said second hook and said second wing being integrally formed and supported in a region intermediate the respective ends of said second hook and said second wing, said first and second wings having respective surfaces for guiding an impinging male member toward said opening during movement of said male member toward said female structure.

22. A plastic zipper comprising first and second fastener strips, wherein said first fastener strip comprises a male member having a profile with a base and an expanded head and said second fastener strip comprises a female structure having a profile with a groove for receiving said expanded head of said male member, and wherein said female structure comprises a base, first and second walls extending from said base, first and second hooks extending from said first and second walls respectively toward a center plane, and first and second target apices located away from said center plane, said first and second hooks, when in a relaxed state, forming an opening having a width less than a width of said expanded head of said male member, enabling said first and second hooks to latch said male member to provide an interlocked state of said first and second fastener strips, and the distance between said first and second target apices defining a target width, wherein said zipper has a ratio of target width to zipper height substantially equal to or greater than unity when said zipper is closed.

23. A package comprising a receptacle having a mouth at an upper end and a plastic zipper as recited in claim 22 attached to said mouth.

* * * * *